US005316026A

United States Patent [19]

Jenkins

[11] Patent Number: 5,316,026

[45] Date of Patent: May 31, 1994

[54] METHOD AND APPARATUS FOR APPLYING DECORATION TO NAILS

[75] Inventor: Nevin Jenkins, Homosassa, Fla.

[73] Assignee: Fashion Nails, Inc., Miami, Fla.

[21] Appl. No.: 900,446

[22] Filed: Jun. 18, 1992

Related U.S. Application Data

[63] Continuation-in-part of Ser. No. 830,321, Jan. 31, 1992, abandoned.

[51] Int. Cl.[5] ..... A45D 29/00

[52] U.S. Cl. ..... 132/285; 132/73; 132/73.5; 132/200

[58] Field of Search ..... 132/73, 73.5, 74.5, 132/200, 285, 333

[56] References Cited

U.S. PATENT DOCUMENTS

| | | | |
|---|---|---|---|
| 2,031,225 | 2/1936 | O'Donnell | 132/285 |
| 2,180,519 | 11/1939 | Hamilton et al. | 132/285 |
| 2,220,758 | 11/1940 | Florio | 132/285 |
| 2,262,977 | 11/1941 | Vasil | 132/285 |
| 2,287,062 | 6/1942 | Powers et al. | 132/285 |
| 2,454,004 | 11/1948 | Pettyjohn | 132/285 |
| 2,485,384 | 10/1949 | Klein | 132/285 |
| 2,580,893 | 1/1952 | Dee | 132/285 |
| 2,799,282 | 7/1957 | Slack | 132/285 |
| 3,461,885 | 8/1969 | Coveney | 132/285 |
| 3,480,020 | 11/1969 | Ernest | 132/74.5 |
| 3,515,154 | 6/1970 | La Morgese | 132/285 |

*Primary Examiner*—Gene Mancene
*Assistant Examiner*—Frank A. LaViola
*Attorney, Agent, or Firm*—Keck, Mahin & Cate

[57] ABSTRACT

Method and apparatus for making a decorative pattern on a finger or toe nail using fixture that may be a two part hinged fixture that receives a screen and holds it in juxtaposition to a nail. Articulated arms or a base plate position the fixture relative to the finger or toe, with the nail exposed through the fixture. A screen is inserted into the fixture. A coloring liquid is put onto the screen and is expressed through the screen by a squeegee that coacts with the fixture and resiliently deflects the screen. The part of the fixture holding the screen can be pivoted up and away from the nail to avoid smearing and facilitate changing of the screen. Multi-color patterns can be made by using a plurality of screens with different coloring liquids, such as nail polishes or lacquers.

8 Claims, 3 Drawing Sheets

METHOD AND APPARATUS FOR APPLYING DECORATION TO NAILS

This is a continuation-in-part of U.S. patent application Ser. No. 07/830,321, filed Jan. 31, 1992, now abandoned.

FIELD OF INVENTION

The present invention relates to a method and apparatus for applying colors and patterns to finger and toe nails for decorative purposes.

BACKGROUND OF INVENTION

Although coloring or otherwise decorating finger and toe nails with patterns is a common practice, usually this is done manually in a painstaking and tedious manner. Prior art apparatus and methods exist for effecting such decoration plastic or have employed a simple stencil that usually consists of a metal plate with holes through which nail lacquer can be applied to a nail. Unfortunately, the fit between the plate and nail is poor and lacquer either is smeared when the plate is removed from the nail or leaks under the plate.

SUMMARY OF INVENTION

The present invention provides a method and apparatus for applying color or decorative patterns to finger or toe nails in an expeditious and neat fashion. This is accomplished by apparatus in the form of a fixture or jig that can be detachably mounted on a finger or toe in suitable juxtaposition to a finger nail or toe nail which cooperates with a silk screen held in a holder that itself is held in the properly spaced juxtaposition relative to the nail undergoing decoration. An applicator coacts with both the fixture and the silk screen or the like mounted in the holder in a unique way to apply to the nail a liquid decoration such as a quick drying nail lacquer or polish.

The method comprises establishing a well above a nail to be treated or decorated, resiliently positioning a silk screen or the like in the well in proper juxtaposition to the nail, slightly spaced above it, introducing a decorating liquid, such as nail polish, into the well on the screen and depressing (deflecting) and biasing the screen toward the nail (in a line contact) while expressing an appropriate amount of the liquid through the biased screen to create the decorative pattern or at least a portion thereof on the nail. By changing screens and using different color nail polishes or lacquers, multicolor patterns can be made.

DETAILED DESCRIPTION OF PREFERRED EMBODIMENT

Figure 1:
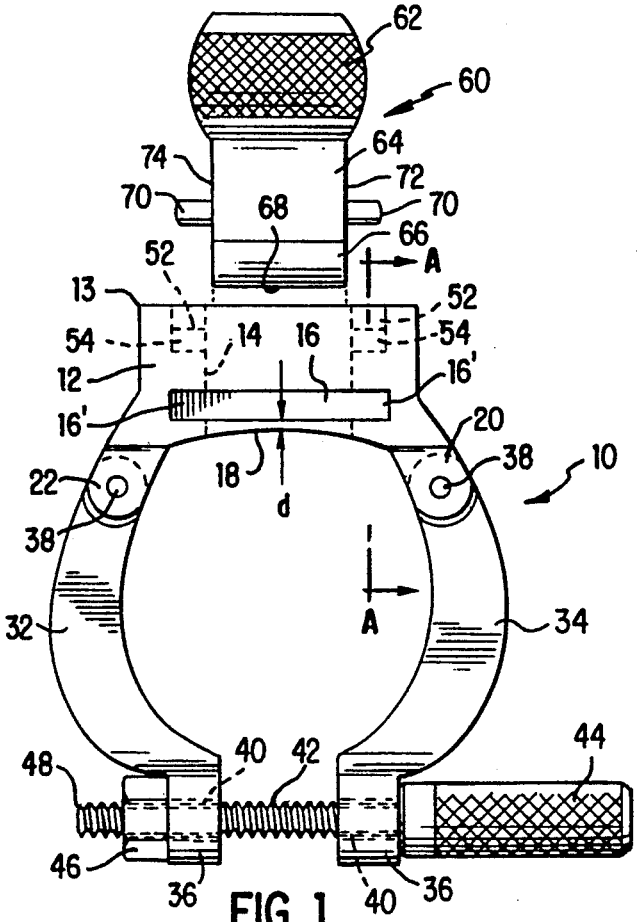
FIG. 1 is a view in side elevation from the front showing the novel fixture and coacting squeegee.
Figure 2:
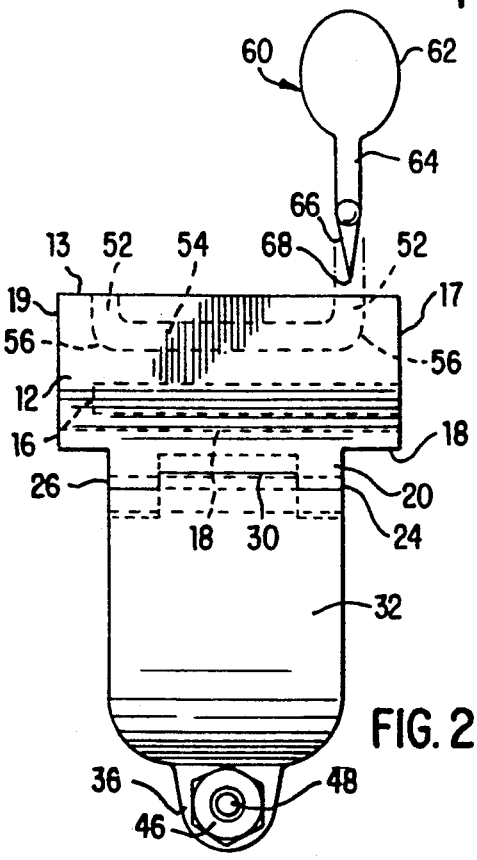
FIG. 2 is a view in end elevation of the novel apparatus shown in FIG. 1.
Figure 3:
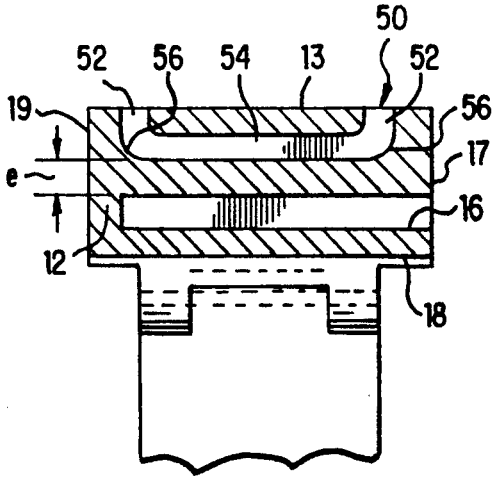
FIG. 3 is a view in cross section taken along line A—A of FIG. 1.

Referring now to the drawings in detail FIGS. 1-3 show the novel apparatus. A fixture or jig 10 consists of a parallelpiped main body 12 having a vertically extending throughbore 14 of square or rectangular cross section that serves as a well. A bore or slot 16 extends horizontally into main body 12 from one side 17 spaced a predetermined distance d above the bottom 18 of the main body 12 and terminates spaced from opposite side 19. Bottom 18 is arcuate and curves to the same extent or degree as a finger nail or a toe nail. Slot 16 is wider than well 14 with portions 16' extending into main body 12 on both sides of well 14.

The bottom 18 of main body 12 is bifurcated to form depending legs 20 and 22. Each leg is bifurcated to form ears 24 and 26 spaced apart on each side of their associated leg. Fitted into the space defined between each pair of ears 24 and 26 is the reduced section 30 of an arcuate pincer arm 32, 34. Arms 32, 34 are wide bands, as shown in FIG. 2 and terminate at their lower ends in narrowed ears 36 centrally located and vertically depending.

Hinge pins 38 extend through ears 24, 26 and reduced section 30 to enable arms 32, 34 to articulate or pivot relative to main body 12. The ears 36 are each provided with a horizontal through bore 40 and a threaded shaft or screw 42 provided with a knurled handle 44 fixed to one end passes through bores 40. A nut 46 is threaded onto scre 42 at its free end 48. Handle 44 is of larger diameter than screw 42 and bore 36 as is nut 46 so that ears 36 can be drawn together by relative manipulation of nut 46 and handle 44, screw 42 or allowed to move apart.

A slot 50 is formed in main body 12 on opposite sides of well 14, over the extended regions 16' of slot 16. Each slot 50 has two vertically extending, horizontally spaced portions 52 which origlnate at top surface 13 of main body 12 and are joined by connecting portion 54 which extends horizontally spaced a predetermined distance e above the slot 16. Slot 50 is of uniform cross section and the transitions 56 between portions 52 and 54 are smoothly curved.

A broad squeegee 60 consisting of a bulbous top 62, a shank 64 and a lower terminating blade 66 that tapers gradually from shank 64 to a pointed edge 68, is provided with a pair of projecting pins 70 extending from either side 72, 74 of the broad face of the squeegee 60. The width of squeegee 60 is equal to or slightly less than the width of well 14, see FIG. 1, to fit into it loosely. Pins 70 are of slightly lesser diameter than slot 50 so that pins 70 can readily traverse the slots 50. When pins 70 are traversing portion 54, blade 66 and more particularly edge 68 intrudes into or below slot 16.

Figure 4:
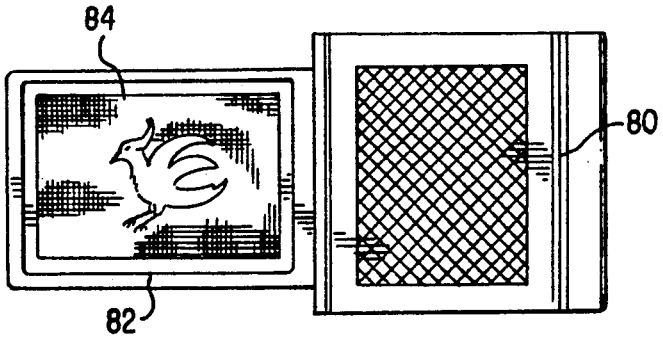
FIG. 4 is a plan view of a novel screen holder with screen.
Figure 5:
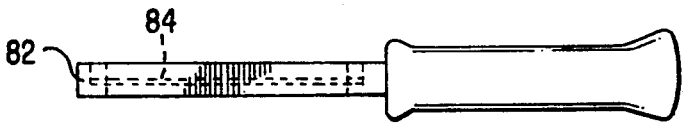
FIG. 5 is a side view of the novel screen holder of FIG. 4.

As shown in FIGS. 4 and 5, a silk screen frame consists of a flat knurled handle 80 from which extends a rectangular frame 82 in which is mounted a silk screen or the like 84 stretched under slight tension or pressure along the bottom edge of the frame 82. Alternatively, the screen 84 can be in a separate frame and received in a rectangular frame holder provided with handle 80. In this way, replacement of a screen can be effected without replacing the entire assembly of the frame holder and handle. The screen frame is loaded into the main body 12 by inserting the frame 82 in the slot 16 which is sized so that frame 82 is easily inserted but the fit is snug without relative movement. The silk screen 84 is composed of silk, organdy or other mesh-like material through which liquid is forced onto the nail through the meshes of the screen which has been prepared to have previous printing areas and impervious non-printing areas.

The method of the invention consists of the steps of positioning the fixture 10 on a nail such as a finger nail by inserting the finger into the opening defined by the bottom 18, arms 32, 34 and screw 42 with the nail in contact with bottom 18 and therefore a portion of the nail exposed in the bottom of well 14. A screen frame is loaded into slot 16 by inserting frame 82 using handle 80. This places a screen 84 at the bottom of slot 16 directly over the portion of nail exposed in the bottom of well 14, spaced above the nail by a distance d. Next, a coloring or non-coloring liquid is placed onto screen 84, frame 82 acting at this time as a well for such liquid. Next, squeegee 60 is inserted into main body 12 by placing pins 70 into slots 50 on one side, say for example, slot portions 52 nearest side 17. When pins 70 traverse associated transitions 56 and enter slot portions 54, the edge 68 of squeegee 60 is deflecting or depressing screen 84 (which is resilient) down onto the exposed nail portion along a line contact. As pins 70 and squeegee 60 is drawn horizontally in slot portions 54 toward side 19 (away from side 17 , the coloring liquid, for example, is expressed through screen 84 along a line contact to duplicate the screen pattern on the nail. As edge 68 moves it depresses or deflects portions of the screen 84 successively along line contacts in the traversing direction, while progressively relieving or releasing the screen 84 in the direction opposite to traversing. Therefore, only a narrow line or strip of screen 84, roughly equivalent to the bottom edge of the squeegee, contacts the nail at any given time interval, avoiding prolonged contact and preventing any smearing of the pattern from occurring.

When one screen has been used, it can be withdrawn and replaced with another screen and so forth. In this manner multi-color patterns can be rapidly, neatly and expeditiously created.

The slot 16 can be arcuate instead of straight in which case frame and blade 66, edge 68 will also be arcuate to the same curve or radius. Further, whereas coloring liquids (adhesives) such as nail polishes and lacquers are described, colorless liquids can also be used in conjunction with particles or powders which whcn sprinkled onto a colorless liquid will be bonded thereto to create a pattern on the nail.

Figure 6:
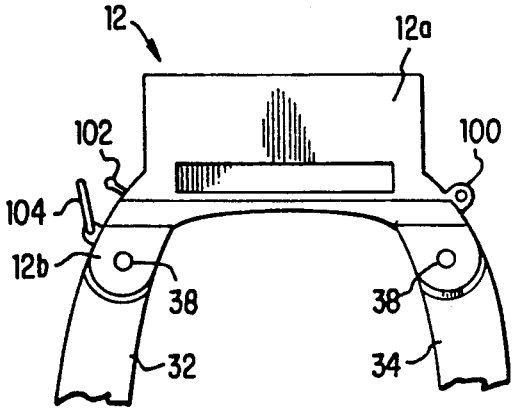
FIG. 6 is a view in side elevation from the front showing a variation.

A variation is shown in FIG. 6 and consists of making the main body 12 in two parts 12*a* and 12*b* divided by a horizontal plane. Hinges 100 hold parts 12*a* and 12*b* together along one edge for relative pivotal movement. A quick detachable connection, shown as a bulbous stud 102 on part 12*a* and loop of wire 104 anchored to part 12*b* enables the two parts to be detachably together.

Figure 7:
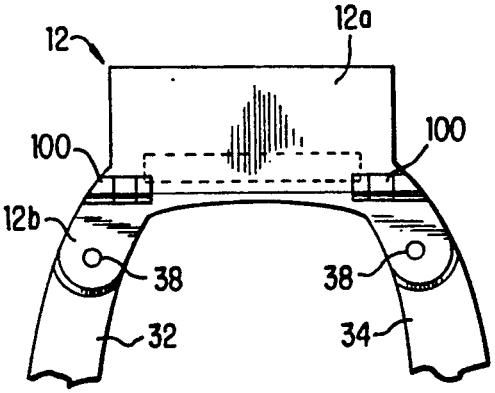
FIG. 7 is a view in side elevation from the rear showing another variation.
Figure 8:
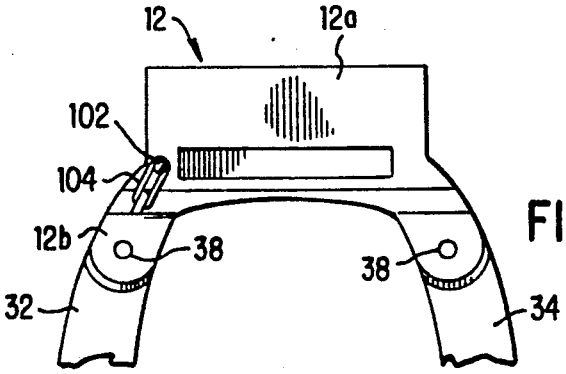
FIG. 8 is a view in side elevation from the front showing the variation of FIG. 7.

Another variation is shown in FIGS. 7 and 8. Here hinges 100 are at the back and connection 102, 104 is at the front. Both variations enable part 12*a* to be pivoted up and away from part 12*b* thereby positively moving the screen held in part 12*a* away from a fingernail positioned in the apparatus avoiding smearing and facilitating screen changing.

Figure 9:
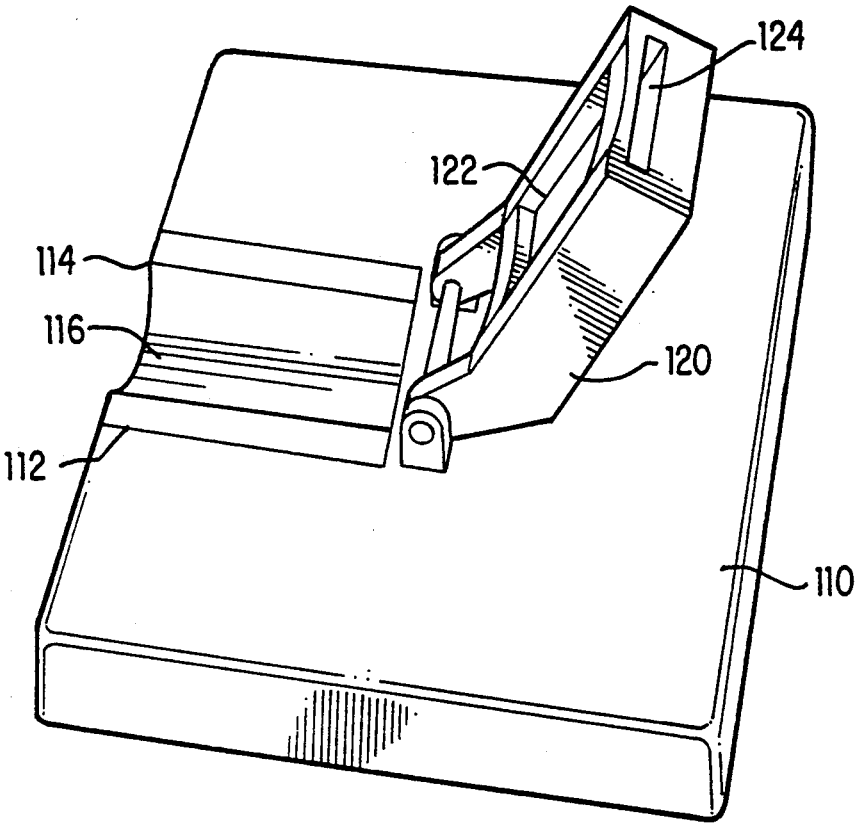
FIG. 9 is a view in perspective showing a further modification.

Another modification is shown in FIG. 9. A base plate 110 has a outout 112 to receive (removably) a block 114 defining groove 116 for holding a finger with its nail facing up. A well 120 having a central throughhole (well) 122 also defines slot 124 for receiving a screen as described with reference to FIGS. 1-3. Well 120 is also provided with slots to enable a squeegee, as described in FIGS. 1-5, to function. Well 120 is pivotally mounted adjacent block 114 on plate 110 by means of trunions 126 and pivot pin 128 to pivot from an u position as shown in FIG. 9 (for screen loading) to a down position (overlying a fingernail for application).

Although the invention has been described in terms of a preferred embodiment, changes are possible which do not depart from the teaching of the invention, such are deemed to fall within the purview of the appended claims.

What is claimed is:

1. Apparatus for making a decorative pattern on a finger or toe nail comprising resilient screen means for creating a decorative pattern including a tensioned resilient screen allowing resilient deflection under an applied force, said resilient screen defining pervious and impervious areas and adapted to receive and hold thereon a liquid to be applied to a nail without allowing said liquid to penetrate the pervious areas of said screen by gravity, fixture means for holding said resilient screen means horizontally in juxtaposition relative to a nail with rhe resilient screen spaced a predetermined distance from the nail, and expressing means for expressing liquid through the pervious areas of said resilient screen by resiliently deflecting said screen toward the nail and forcing and expressing liquid held on said resilient screen through the pervious areas of said resiliently deflected screen and onto the nail, wherein the fixture includes a main body having a bottom surface, a top surface and two opposed side surfaces, a vertical throughbore defined in said main body, a first horizontal slot defined in said main body wider than the throughbore and sapced above the bottom surface by a predetermined amount, second and third slots, one on each side of said throughbore, each have a pair of spaced vertical portions leading from the top surface and an interconnecting horizontal portion spaced above the first slot by a predetermined amount and wherein the expressing means includes a squeegee having a pair of projecting pins to coact with the second and third slots and a blade to coact with the screen as the pins traverse the interconnecting hoirzontal portions of the second and third slots.

2. Apparatus according to claim 1 wherein said main body is pivotally mounted on a base.

3. Apparatus according to claim 1 wherein the transition between each vertical portion and interconnecting horizontal portion curves smoothly.

4. A method for making a decorative pattern on a nail such as a finger nail or toe nail comprising the steps of a) positioning a fixture on a finger or toe nail capable of holding a screen in juxtaposition relative thereto, b) insserting a resilient screen having pervious areas and impervious areas in the fixture, c) introducing a liquid onto and maintaining on the resilient screen, and d) resiliently deflecting the screen while expressing the liquid through the deflected and pervious areas of the resilient screen to transfer liquid onto the nail in the pattern of the resilient screen.

5. The method of claim 4 including the further step of moving the screen while in the fixture up and away from the nail.

6. The method of claim 4 wherein the expression occurs as a line advance with the screen contacting the nail only on an advancing line due to the progressive resilient deflection of th screen.

7. The method of claim 4 wherein multi-color patterns are created by successively replacing the screen with a new screen and repeating steps c) and d).

8. The method of claim 5 wherein the screen is removed while the fixture is up and away from the nail.

* * * * *